US010787816B1

(12) United States Patent
Spanos

(10) Patent No.: US 10,787,816 B1
(45) Date of Patent: Sep. 29, 2020

(54) SPRAY FOAM INSULATION VENT

(71) Applicant: Spray Foam Distributors of NE Inc., Woodstock, NH (US)

(72) Inventor: George Spanos, Woodstock, NH (US)

(73) Assignee: Spray Foam Distributors of NE Inc., Woodstock, NH (US)

( * ) Notice: Subject to any disclaimer, the term of this patent is extended or adjusted under 35 U.S.C. 154(b) by 0 days.

(21) Appl. No.: 16/388,824

(22) Filed: Apr. 18, 2019

(51) Int. Cl.
*E04D 13/17* (2006.01)
*E04D 13/16* (2006.01)

(52) U.S. Cl.
CPC ..... *E04D 13/172* (2013.01); *E04D 13/1625* (2013.01)

(58) Field of Classification Search
CPC ..... E04D 13/172; E04D 13/1625; E04D 13/1637; E04B 1/7654; E04B 1/7666
See application file for complete search history.

(56) References Cited

U.S. PATENT DOCUMENTS 1,848,272 A * 3/1932 Powell ..... E04B 1/7666 52/407.3
3,035,374 A 5/1962 Allen
3,969,868 A 7/1976 Bainter
4,189,878 A 2/1980 Fitzgerald
4,214,510 A 7/1980 Ward
4,292,777 A * 10/1981 Story ..... E04D 13/172 52/407.1
5,567,504 A 10/1996 Schakel
5,600,928 A 2/1997 Hess
6,346,040 B1 2/2002 Best
6,754,995 B1 6/2004 Davis
7,017,315 B2 * 3/2006 Corwin ..... E04B 1/7654 52/404.2
8,733,749 B2 5/2014 Lanciaux
8,782,982 B2 * 7/2014 Lewis ..... E04B 1/7654 52/407.3
9,476,204 B2 * 10/2016 Wolf ..... E04D 13/1637
9,920,516 B2 3/2018 Alter
9,926,702 B2 3/2018 Rockwell
10,563,101 B2 * 2/2020 Fellinger ..... C09J 125/08
2003/0205023 A1 * 11/2003 Corwin ..... E04D 13/1625 52/749.1

(Continued)

OTHER PUBLICATIONS

Smartbaffie Sell Sheet Specs by DCI Products, Rugged Insulation Baffle, www.dciproducts.com, on or before Dec. 17, 2018.

(Continued)

*Primary Examiner* — Rodney Mintz
(74) *Attorney, Agent, or Firm* — Loginov & Associates, PLLC; William A. Loginov

(57) ABSTRACT

A roof ventilation system can be installed between the rafters of an attic prior to the application of spray-in foam insulation. A roof ventilation system can be provided in 4-foot, 8-foot, or other lengths, of foam insulation board that have kerf cuts (i.e. partial cuts) separating the roof ventilation system into a main panel sized to fit between two rafters, and two side panels. The side panels can be folded over 180 degrees to meet the main panel, and an adhesive can secure them in place to form a foundation. The foundation of the roof ventilation system can include a roof adhesive that can secure the roof ventilation system to the underside of the roof between rafters.

12 Claims, 7 Drawing Sheets

(56) References Cited

U.S. PATENT DOCUMENTS

| | | | | |
|---|---|---|---|---|
| 2004/0250490 | A1* | 12/2004 | Hall | E04B 1/7654 52/506.01 |
| 2011/0271626 | A1* | 11/2011 | Lewis | E04B 1/7654 52/407.3 |
| 2013/0276385 | A1* | 10/2013 | White | B32B 5/18 52/90.1 |
| 2014/0007533 | A1* | 1/2014 | Wadsworth | E04B 1/7629 52/309.1 |
| 2015/0218802 | A1* | 8/2015 | Wolf | E04D 13/1637 52/404.3 |
| 2015/0218803 | A1 | 8/2015 | Rockwell | |
| 2015/0233110 | A1* | 8/2015 | Alter | E04B 1/7658 52/404.2 |
| 2015/0345135 | A1* | 12/2015 | Watanabe | E04C 2/386 52/773 |
| 2018/0208806 | A1* | 7/2018 | Fellinger | C09J 133/02 |

OTHER PUBLICATIONS

Smartbaffle Spray Foam Brochure, smartbaffle.com, on or before Dec. 17, 2018.
DCI Products National Reference Chart, on or before Dec. 17, 2018.

* cited by examiner

SPRAY FOAM INSULATION VENT

FIELD OF THE INVENTION

The present invention relates to venting systems for spray-in foam insulation as well as other insulation systems, and more particularly to foam insulation boards that can be used for venting systems.

BACKGROUND OF THE INVENTION

Spray-in foam is a popular form of insulation that can be added to the attic of a home during new-home construction or at any time the homeowner wishes to increase the insulation in an attic. Spray-in foam can be sprayed on the roof deck (i.e. the underside of the roof) and between the rafters of a roof. The spray foam can then expand in size and harden to create an insulative and airtight barrier.

Many attics are intended to be ventilated, and have vents at the eaves and peaks of a roof. Fresh air typically enters through the eaves, travels along the roof deck between the rafters, and escapes through vents near the peak. This system of ventilation can prevent the buildup of moisture within the attic and joists and more generally equalizes the temperature between the roof exterior and the roof interior surfaces. However, spray-in foam insulation (also termed, "spray foam") can substantially limit or eliminate the benefits of roof ventilation by expanding to fill in the travel path of the air. More particularly, spray foam is an air impermeable insulation, unlike conventional fiberglass. Some manufacturers of shingles actually require roof venting, as an unvented roof may void the shingle warranty.

A number of ventilation system have been devised, many of which can be nailed in place between the rafters to protect a layer of air under the spray-in foam. These ventilation systems can allow air to continue to travel under the roof deck between the eaves and the upper vents, while the spray-in foam insulation provides an insulation barrier to protect the home. However, many of these existing ventilation systems are flimsy and difficult to use. Some provide only a minimum of air flow, and require a skilled operator to carefully place them with the correct spacing away from the roof deck. Many prior art systems have flaps that fold inward towards the user and must be secured to the rafter. These systems require the user to measure or guess how close to place the ventilation system to the roof deck and then carefully secure the ventilation system in the correct position to allow enough space for the spray-in foam insulation between the rafters and also allow appropriate ventilation space under the roof deck after the spray in foam expands. At the same time, the operator must securely nail the flaps or otherwise secure them to the rafters while also maintaining optimal ventilation spacing. Failure to secure them properly can result in failure as the expanding foam crushes the ventilation system against the roof deck and possibly even pulls it away from the rafters. What is needed is a convenient, easy to use roof vent system that can be installed quickly and easily with optimal ventilation spacing, and can withstand the pressure of expanding foam without collapsing and without requiring nails or other troublesome fasteners.

SUMMARY OF THE INVENTION

The present invention overcomes the disadvantages of the prior art by providing a system and method for roof ventilation to be installed between rafters in an attic before spray-in foam is applied. The ventilation system includes a foam insulation board that has been pre-cut to size and has pre-scored side panels that can be folded back 180 degrees to form foundations that support the foam board and provides a ventilation gap between the main panel and the roof deck. The ventilation system includes an adhesive that can secure the foundations directly to the roof deck so that an installer does not need to correctly figure out the ventilation depth and nail vents to the rafters.

In an exemplary embodiment, a roof ventilation system can comprise a foam insulation board that can be divided into a main panel and two side panels by two kerf cuts. The kerf cuts can extend from an interior side of the foam insulation board towards an exterior side of the foam insulation board without cutting through the exterior of the foam insulation board. The foam insulation board can have breakaway sections between the main panels and the side panels. A fold adhesive on an exterior side of the foam insulation board can be located between a distal edge of the foam insulation board and a position that is twice the width of the side panel from the distal edge, and a roof adhesive can be on an exterior side of the side panels.

The kerf cuts can extend from the interior side of the foam insulation board towards the exterior side of the foam insulation board in a range from 50% to 95% of the thickness of the foam insulation board. The kerf cuts can extend from the interior side of the foam insulation board towards the exterior side of the foam insulation board through 75% of the thickness of the foam insulation board. The kerf cuts can be perpendicular to the interior side of the foam insulation board. The fold adhesive can be on an exterior surface of the side panels. The fold adhesive can be on an exterior surface of the main panel in a region bounded on a first side by a position that can be twice the width of the side panel from the distal edge, and bounded on a second side by a position that can be the width of the side panel from the distal edge.

In an exemplary embodiment, a method of installing a roof ventilation system can comprise folding two side panels of a foam insulation board upwards to break a breakaway section so that the side panels are hingedly attached to a main panel by an outer layer of the foam insulation board, removing a protective cover from a fold adhesive on the outer layer of the foam insulation board, folding the side panels around 180°, securing the side panels in the 180° position with the exterior side of the side panel adhered to the exterior side of the main panel, removing a protective cover from a roof adhesive on the interior surface of the side panels, and pressing the roof ventilation system between two rafters so that the main panel extends between the rafters and the roof adhesive is secured to the underside of a roof, thereby forming a vent between the underside of the roof, the side panels, and the main panel.

In another exemplary embodiment, a method of manufacturing a roof ventilation system can include slitting an approximately 4-foot to 8-foot wide foam insulation board blank into 2 to 8 foam insulation boards. The 2 to 8 foam insulation boards are kerfed into a main panel and two side panels with a breakaway section between the main panel and the side panels. A fold adhesive is applied on an exterior side of the foam insulation board, the fold adhesive located between a distal edge of the foam insulation board and a position that is twice the width of the side panel from the distal edge, and a roof adhesive is applied on an interior side of the side panels. In an example, the insulation board is approximately 4 feet wide, and is slit into 2 to 4 foam insulation boards. In an alternate example, the insulation board is approximately 8 feet wide, and is slit into 4 to 8 foam insulation boards. The fold adhesive and/or the roof adhesive can be an adhesive tape with a removable backing that is removed to apply it to the foam insulation board. The opposing, exposed side of each adhesive tape can also include a removable backing that is peeled away by a user to expose a layer of adhesive at installation time.

BRIEF DESCRIPTION OF THE DRAWINGS

The invention description below refers to the accompanying drawings, of which.

DETAILED DESCRIPTION

Figure 1:
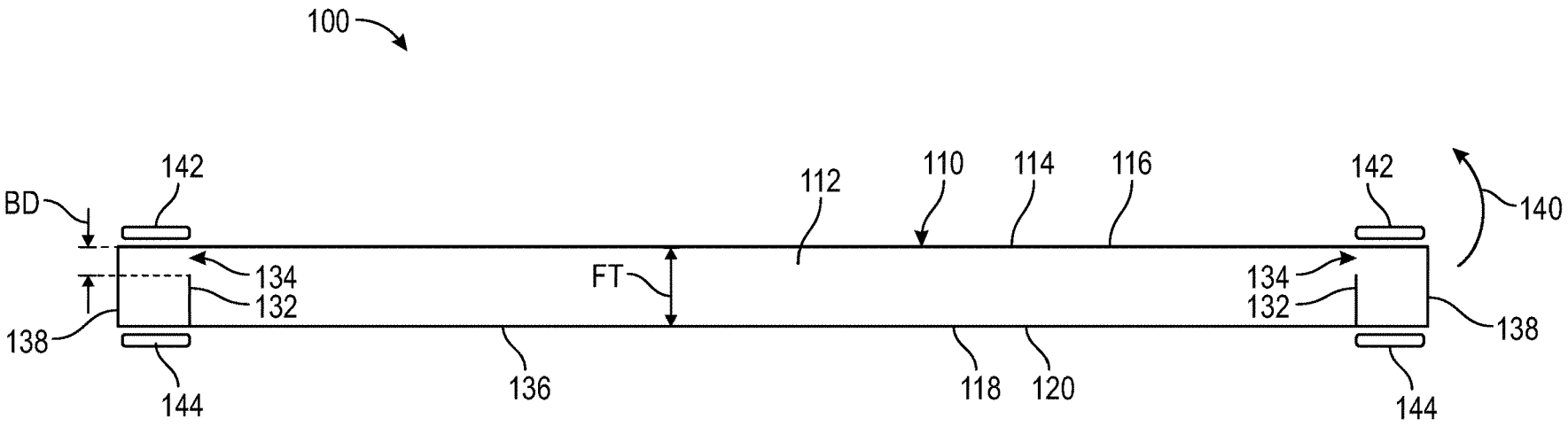
FIG. 1 is a schematic end view of a roof ventilation system in a storage conformation, according to an illustrative embodiment.

FIG. 1 is a schematic end view of a roof ventilation system in a storage conformation, according to an illustrative embodiment. A roof ventilation system 100 can include a foam insulation board 110. Various versions of foam insulation board are commonly available and will be understood by one skilled in the art. A foam insulation board 110 can typically include an insulative foam body 112 that can have a thickness FT in a range of one to two inches. The insulative foam body can be made from an expanded polystyrene, extruded polystyrene, polyisocyanurate, or various other rigid foam materials. The foam insulation board 110 can include an outer layer 114 of foil or other reflective material covering an exterior side 116 of the foam insulation board 110. The foam insulation board 110 can also have a protective layer 118 of paper, plastic, foil, or other material covering an interior side 120 of the foam insulation board, or can be free of a protective layer. Foam insulation board is commonly installed as insulation with the reflective layer facing out towards the unconditioned environment such as facing the exterior of a home, and the interior side can face inwards towards the conditioned environment, or inside of the home.

A roof ventilation system 100 can have two kerf cuts 132 (i.e. partial cuts) that can extend the entire length of the foam insulation board 110. Kerf cuts 132 can extend from the interior side 120 towards the exterior side without (free of) penetrating the exterior side. The kerf cuts 132 can extend from the interior side 120 approximately 50% or more of the way through the board 110 towards the exterior side 116 without (free of) penetrating the outer layer 114. In various embodiments, kerf cuts 132 can extend 75% of the way through the board. The kerf cuts 132 can be perpendicular to the interior side 120 and exterior side 116 of the foam board 110. A remaining depth of the foam board 110 between the end of the kerf cut 132 and the outer layer 114 can be a breakaway section 134 that can have a depth BD in a range of, for example, approximately 0.5 inches to 0.1 inches. The kerf cuts 132 and breakaway sections 134 can divide the board 110 into a main panel 136 and two side panels 138. Kerf cuts 132 can be deep enough so that the remaining uncut depth of foam 112 that is the breakaway section 134 between the end of the cut 132 and the exterior side 116 can be broken or snapped by a user who folds the side panels 138 upwards along arrow 140. After the breakaway section 134 has been broken, the side panel 138 can remain hingedly attached to the main panel by the outer layer 114.

Side panels 138 can have a fold adhesive 142 and a roof adhesive 144. In various embodiments the fold adhesive 142 and the roof adhesive 144 can be the same or different adhesives. The adhesives 142 and 144 can be an industrial/construction-grade, double-sided tape that is adhered on one side to the foam board 110, and can have a peel away protective cover over the other (opposing/exposed) side, and a user can remove the protective cover to expose the adhesive. Note that the roof adhesive tape can be different in composition on opposing sides to more effectively adhere to foam or a wooden substrate, respectively. That is, in optional implementations, the side of the tape 144 that is applied to the foam is adapted for foam substrates and the side that is meant to adhere to the roof interior surface is adapted to adhere more effectively to wood or other similar materials.

Figure 2:
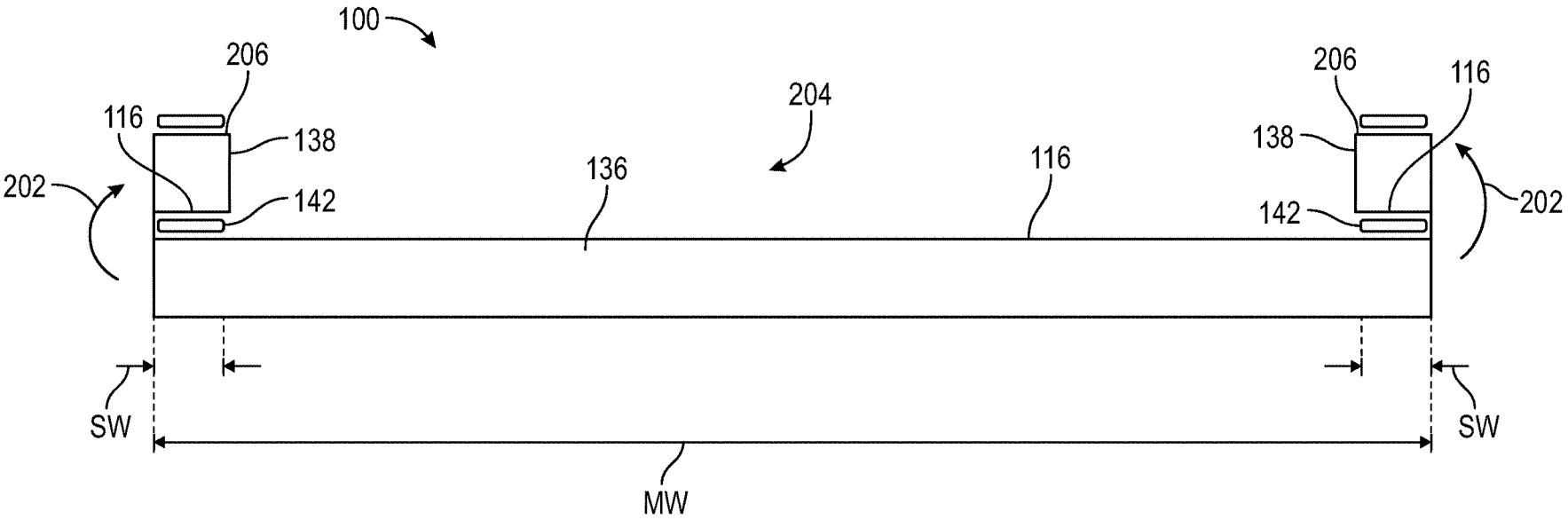
FIG. 2 is a schematic end view of the roof ventilation system of FIG. 1 folded into an installation conformation, according to an illustrative embodiment.

FIG. 2 is a schematic end view of the roof ventilation system of FIG. 1 folded into an installation conformation, according to an illustrative embodiment. The roof ventilation system 100 can be shipped and stored in the storage conformation shown in FIG. 1, and can be folded into the installation conformation shown in FIG. 2 on site before installation. A user can remove the protective cover from the fold adhesive 142, and can fold the side panels 138 upwards 180° along arrow 202 so that the adhesive secures the side panels in the 180° position shown in FIG. 2. In this position, the fold adhesive 142 can secure the exterior side 116 of the side panel 138 to the exterior side 116 of the main panel 136. With the side panels 138 secured in the folded position, the side panels 138 are now in position to form the foundation 206 of the roof ventilation system. In this installation conformation, the main panel 136 and the two side panels 138 can form a vent channel 204.

The main panel 136 can be sized to fit between the rafters in an attic. The main panel 136 can have a main panel width MW in a range between approximately 9.5 inches and approximately 10.5 inches for use in 12-inch spaced rafters. The main panel 136 can have a main panel width MW of approximately 10 inches. The main panel 136 can have a main panel width MW in a range between approximately 13.5 inches and approximately 14.5 inches for use in 16-inch spaced rafters. The main panel 136 can have a main panel width MW of approximately 14 inches. The main panel 136 can have a main panel width MW in a range between approximately 21.5 inches and approximately 22.5 inches for use in 24 inch spaced rafters. The main panel 136 can have a main panel width MW of approximately 22 inches. Narrower main panel widths are also possible, however, narrower main panel widths would result in larger gaps between the main panel and the rafters. The side panels can have a side panel width SW in a range between approximately 1 and 4 inches. The side panels can have a side panel width SW that can be approximately 1 inch. The side panel width is preferably approximately one inch or more, and should be small enough so that after folding, the vent channel is large enough to form a sufficient vent.

Figure 3:
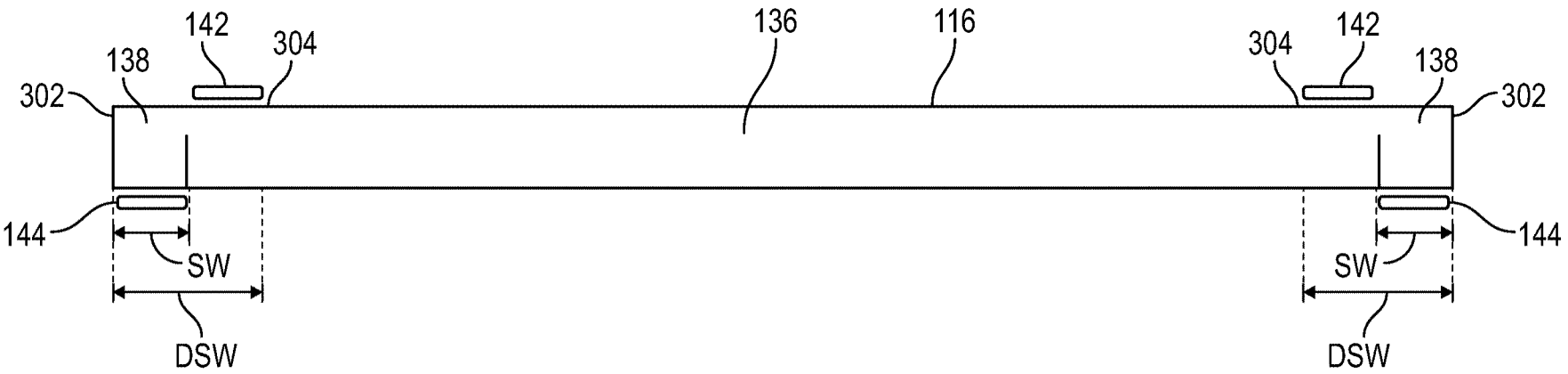
FIG. 3 is a schematic end view of a roof ventilation system in a storage conformation with adhesive in a second position, according to an illustrative embodiment.

FIG. 3 is a schematic end view of a roof ventilation system in a storage conformation with fold adhesive in a second position, according to an illustrative embodiment. In various embodiments, the fold adhesive 142 can be placed on the external side 116 of the main panel 136 instead of being on the side panel 138. In various embodiments, the fold adhesive 142 can be placed anywhere between the distal edge 302 of the side panel 136 and position 304. Position 304 can be a distance DSW from the distal edge 302, where distance DSW is double the side panel width SW.

The roof ventilation system 100 can be shipped and stored in the flat storage conformation to maximize the number of parts that can be stored in a given space, and to reduce the possibility of the roof ventilation system being damaged in transit. Multiple panels of the roof ventilation system 100 can be stacked and bundled together so that a group of them can reinforce, support, and protect each other. The pre-cut panels with adhesive already in place can then be snapped and adhered into the installation conformation quickly and easily just before installation. The user can remove the protective cover from the roof adhesive 144 to prepare the roof ventilation system 100 to be installed.

Figure 4:
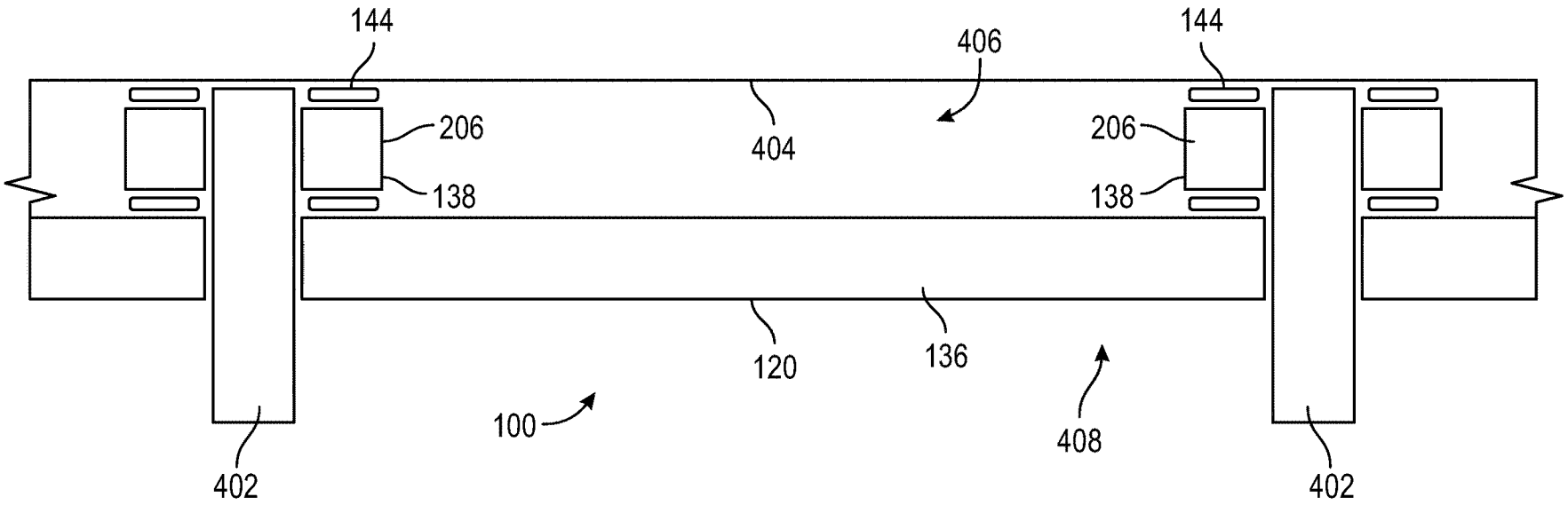
FIG. 4 is a schematic end view of the roof ventilation system installed in a roof before spray-in foam insulation is added, according to an embodiment.

FIG. 4 is a schematic end view of the roof ventilation system installed in a roof before spray-in foam insulation is added, according to an embodiment. After removing the protective cover from the roof adhesive 144 on the foundation 206, the roof ventilation system 100 can be pressed into place between the rafters 402 and against the roof deck 404. The main panel 136 is sized to fit between the rafters, or put another way, the distance between the kerf cuts can be the same as the distance between the rafters. In various embodiments, the distance between the kerf cuts can be slightly less than the distance between the rafters. The roof deck 404, side panels 138, and main panel 136 together can form the vent 406 that allows air to travel along the inside of the roof between the eaves and the upper roof vents. The roof ventilation system 100 includes the foundation 206 that is secured to the roof deck 404.

The roof installation system can be installed in a matter of seconds, and automatically provides an appropriately sized gap for the vent 406 between the main panel 136 and the roof deck 404. This is a significant improvement over prior art systems with flaps that fold inward towards the user and must be secured to the rafter after the correct placement has been measured.

The interior side 120 of the main panel and the sides of the rafters 402 can form a spray-in foam insulation channel 408. After the roof ventilation system 100 is installed as shown in FIG. 4, spray-in foam insulation can be sprayed into the insulation channel 408, and the spray-in form insulation can expand to fill the insulation channel without (free-of) expanding into the eaves or the roof vents, and without (free-of) collapsing the vent 406. The foundation 206 is braced against the roof deck 404 and can provide support to the main panel 136. Together/collectively, the rigid foundation 206 and rigid main panel 136 provide a rigid structure that can withstand the force of the expanding spray-in foam insulation and prevent panel 136 from collapsing towards the roof deck 404 as the spray-in foam insulation expands. In addition to providing structural support for the vent 406, the foam insulation board 110 can also provide further insulation that complements the spray-in foam.

Figure 4A:
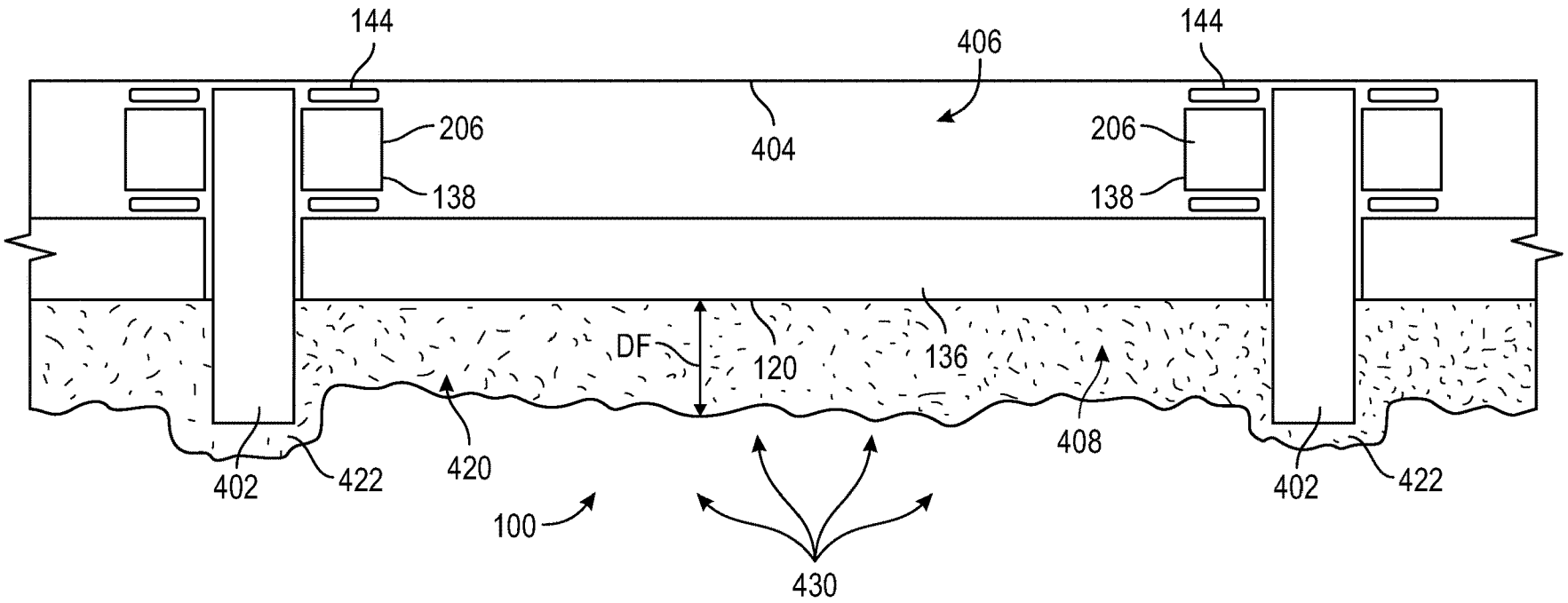
FIG. 4A is a schematic end view of the roof ventilation system of FIG. 4 after spray-in foam is added.

FIG. 4A shows an example of the arrangement 100 of FIG. 4 with spray-in foam 420 applied over the panels 136. A vent/gap 406 remains while the foam fully seals the interior-facing side 430 of the structure. The foam 420 seals up to, and potentially over (foam region 422), the rafters 402. The roof adhesive and/or tape 144 effectively holds the panel 136 in place while the foam is fully applied and allowed to expand/cure. The cured foam generally retains the panels in place permanently. Note that the depth DF of cured foam is highly variable in alternate implementations. Also, in certain implementations, spray foam can be replaced with, or supplemented by multiple layers of insulation board and/or spun fiberglass.

The roof ventilation system can be installed in seconds. In a first step, a user can fold the side panels upwards to snap the breakaway section, and can remove the protective cover from the fold adhesive. The user can then fold the side panels around 180° degrees and secure the external side of each side panel to the external side of the main panel so that the side panels form the foundation. The user can then remove the protective cover from the roof adhesive and press the roof ventilation system into place between the rafters and against the roof deck. The system can be installed quickly and without (free of) needing to measure widths or cut along the length of the panel, without (free of) needing to measure the correct placement or depth between rafters of the panel, and without (free of) needing to nail or otherwise secure the panel after it has been pushed into place.

Multiple roof ventilation systems can be laid end to end between a pair of rafters to extend from the eaves to the roof peak. Because of the rigid structure of the foundation and the main panel, the end-to-end roof ventilation systems will automatically be aligned with each other as if they were a single piece, with the vent extending from one to the other, and the main panels effortlessly abutted to one another to seal out the expanding spray-in foam insulation.

Figure 5A:
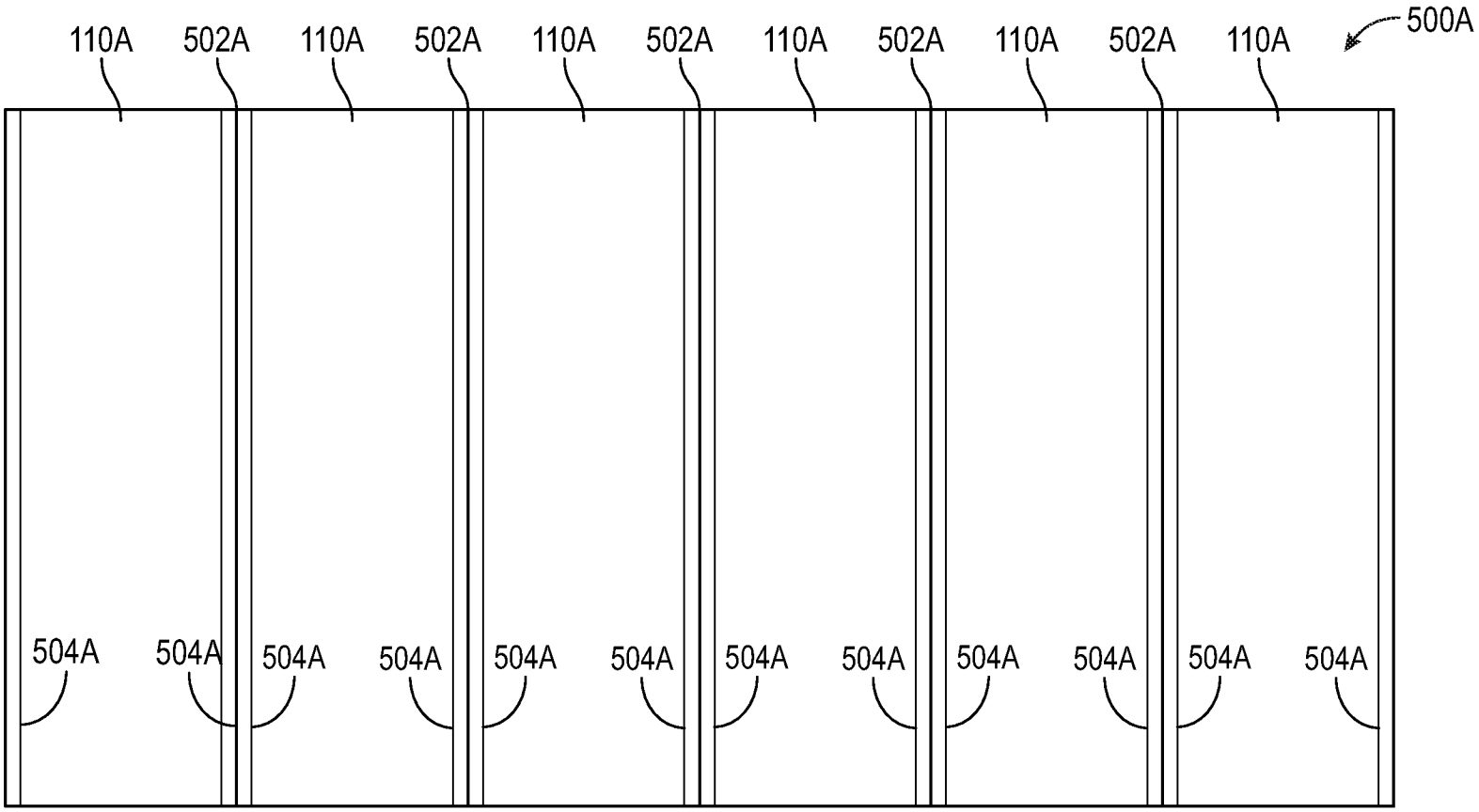
FIG. 5A is is a schematic plan view of the interior side of a standard-sized sheet of foam insulation board that has been slit and kerfed to be 4-foot long segments of roof ventilation systems, according to an illustrative embodiment.

FIG. 5A is a schematic plan view of the interior side of a standard sheet of foam insulation board that has been slit and kerfed to be 4-foot long segments of roof ventilation systems, according to an illustrative embodiment. More generally, FIG. 5A shows an exemplary method of manufacturing a roof ventilation system designed for 16 inch-spaced rafters. Manufacturing of roof ventilation systems for 16-inch spaced rafters can be accomplished by slitting a standard 4×8 sheet 500A of foam insulation board into six separate 4-foot long foam insulation boards 110A for use in roof ventilation systems. Slit cuts 502A can separate the blank sheet 500A into six foam insulation boards 110A that can be 16 inches wide. Kerf cuts 504A can divide each insulation board 110A into, for example, a 14-inch main panel and two 1-inch side panels with breakaway sections between the main panel and the side panels. Kerf cuts 504A can be cut prior to, or at the same time as the slit cuts 502A. For the sake of clarity, the slit cuts 502A are shown in FIG. 5A as broader lines than the kerf cuts 504A, but it should be clear that the slit cuts and the kerf cuts can be the same width. Adhesive/tape can be applied before or after the cuts are made.

Various sizes of boards and panels are explicitly contemplated. By way of non-limiting example, a blank sheet can be slit into five foam insulation boards (not shown) that can be approximately 19.2 inches wide, and kerf cuts can divide each insulation board into a 14.2 inch main panel and two 2.35 inch side panels.

Manufacturing of roof ventilation systems for 12-inch spaced rafters can be accomplished similarly by, for example, slitting a blank sheet 500A into six foam insulation boards that can be 16 inches wide, and applying kerf cuts that separate the foam insulation boards into, for example, a 10.5-inch main panel and two 2.75-inch side panels. In various embodiments, manufacturing of roof ventilation systems for 12-inch spaced rafters can be accomplished by, for example, slitting a blank sheet 500A into seven or eight foam insulation boards that can be kerfed into main panels and side panels. Manufacturing of roof ventilation systems for 24-inch spaced rafters can be accomplished similarly by slitting a blank sheet 500A into eight foam insulation boards that can be 24 inches wide, and applying kerf cuts that separate the foam insulation boards into, for example, a 22-inch main panel and two 1-inch side panels. Manufacturing of multiple sizes of roof ventilation systems can be combined together. For example, a blank sheet 500A can be slit into two 28-inch boards with 22-inch main panels and 3-inch side panels, and two 20 inch boards with 14-inch main panels and 3-inch side panels. Adhesive/tape can be applied before or after the cuts are made. In various exemplary implementations, the main panels and the side panels can be different widths, and the widths of the side panels and the main panels can be determined by the distance between rafters, the size of the blank sheet, and a side panel width that is large enough to be supportive, structurally stable, and snap properly at the kerf cut, while being small enough to allow a sufficient vent size.

Figure 5B:
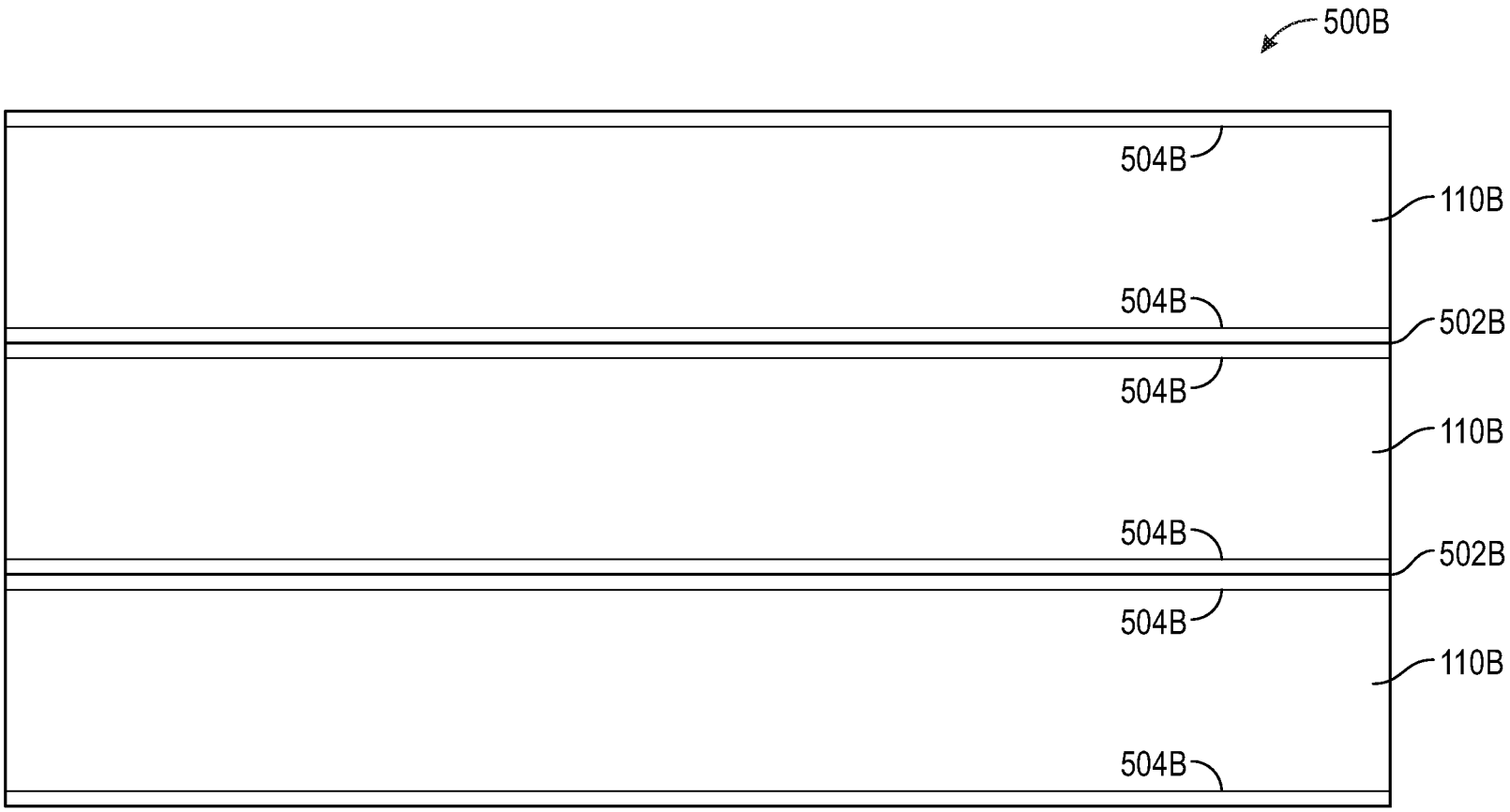
FIG. 5B is a schematic plan view of the interior side of a standard-sized sheet of foam insulation board that has been slit and kerfed to be 8-foot long segments of roof ventilation systems, according to an illustrative embodiment.

FIG. 5B is a schematic plan view of the interior side of a standard sheet of foam insulation board that has been slit and kerfed to be 8-foot long segments of roof ventilation systems, according to an illustrative embodiment. Likewise, FIG. 5B shows an exemplary method of manufacturing a roof ventilation system designed for 16 inch-spaced rafters. Manufacturing of roof ventilation systems for 16-inch spaced rafters can be accomplished by slitting a standard 4×8 sheet 500B of foam insulation board into three separate 8-foot long foam insulation boards 110 for use in roof ventilation systems. Slit cuts 502B can separate the blank sheet 500B into three foam insulation boards 110B that can be 16 inches wide. Kerf cuts 504B can divide each insulation board 110B into, for example, a 14-inch main panel and two 1-inch side panels with breakaway sections between the main panel and the side panels. Kerf cuts 504B can be cut prior to, or at the same time as the slit cuts 502B. For the sake of clarity, the slit cuts 502B are shown in FIG. 5 as broader lines than the kerf cuts 504B, but it should be clear that the slit cuts and the kerf cuts can be the same width. Adhesive can be applied before or after the cuts are made.

Manufacturing of roof ventilation systems for 12-inch spaced rafters can be accomplished similarly by slitting a blank sheet 500B into three foam insulation boards that can be 16 inches wide, and applying kerf cuts that separate the foam insulation boards into, for example, a 10.5-inch main panel and two 2.75-inch side panels. Manufacturing of roof ventilation systems for 24-inch spaced rafters can be accomplished similarly by slitting a blank sheet 500B into two foam insulation boards that can be 24 inches wide, and applying kerf cuts that separate the foam insulation boards into, for example, a 22-inch main panel and two 1-inch side panels. Manufacturing of multiple sizes of roof ventilation systems can be combined together. For example, a blank sheet 500B can be slit into a 28-inch board with a 22-inch main panel and two 3-inch side panels, and a 20 inch board with a 14-inch main panel and two 3-inch side panels. Adhesive/tape can be applied before or after the cuts are made.

It should be clear that the above examples of cuts are only exemplary, and in various embodiments the main panels and the side panels can be different widths. The widths of the side panels and the main panels can be determined by the distance between rafters, the size of the blank sheet, and a side panel width that is large enough to be supportive, structurally stable, and snap properly at the kerf cut, while being small enough to allow a sufficient vent size. It should be further clear that the above-described system for providing venting to a roof interior that is subsequently covered in spray foam provides an effective and permanent structure that avoids eventual disconnection of components and allows for a highly insulated space between rafters with ample and unobstructed venting at the roof interior surface.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, roof installation systems can be manufactured with various lengths that can include 8-foot, 6-foot, 4-foot, shorter lengths, or other lengths. Additionally, the term "kerf" should be taken broadly to include non-continuous (along the linear cut direction) cuts that have the effect of a perforated line, as well as other arrangements that allow the "kerfed" edges to be moved from a flattened to a rectilinear orientation to form the channel shape of the vent—for example a through cut that is hinged using a strip of flexible fabric or take on one side of the panel—and (optionally) a sliceable or breakable tape on the opposing side that maintains the plane until broken, and at which time, the edge can hinge rectilinearly. Also, as used herein various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Also, qualifying terms such as "substantially" and "approximately" are contemplated to allow fort a reasonable variation from a stated measurement or value can be employed in a manner that the element remains functional as contemplated herein—for example, 1-5 percent variation. Accordingly, this description is meant to be taken only by way of example, and not to otherwise limit the scope of this invention.

What is claimed is:

1. A roof ventilation system comprising:

a foam insulation board, the foam insulation board divided into a main panel and two side panels by two kerf cuts, the kerf cuts extending from an interior side of the foam insulation board towards an exterior side of the foam insulation board without penetrating through the exterior side of the foam insulation board, the foam insulation board having breakaway sections that hingedly connect the main panel and the side panels;

a fold adhesive positioned on the exterior side of the foam insulation board, the fold adhesive located between a distal edge of the foam insulation board and a position that is twice a width of the side panel from the distal edge; and a roof adhesive positioned on an interior side of the side panels, wherein the foam insulation board is configured to be positioned between two rafters so that the main panel extends between the rafters and the roof adhesive is secured to an underside of a roof, thereby defining a vent located between the underside of the roof, the side panels and the main panel.

2. The roof ventilation system of claim 1, wherein the kerf cuts extend from the interior side of the foam insulation board towards the exterior side of the foam insulation board in a range from approximately 50% to 95% of a thickness of the foam insulation board.

3. The roof ventilation system of claim 1, wherein the kerf cuts extend from the interior side of the foam insulation board towards the exterior side of the foam insulation board through at least approximately 75% of a thickness of the foam insulation board.

4. The roof ventilation system of claim 1, wherein the kerf cuts are perpendicular to the interior side of the foam insulation board.

5. The roof ventilation system of claim 1, wherein the fold adhesive is on an exterior surface of the side panels.

6. The roof ventilation system of claim 1, wherein the fold adhesive is on an exterior surface of the main panel in a region bounded on a first side by a position that is twice the width of the side panel from the distal edge, and bounded on a second side by a position that is the width of the side panel from the distal edge.

7. A method of installing the roof ventilation system of claim 1 comprising the steps of:

folding the two side panels of the foam insulation board upwards to break the breakaway section so that the side panels are hingedly attached to the main panel by an outer layer of the foam insulation board;

removing a first protective cover from the fold adhesive on the outer layer of the foam insulation board;

folding the side panels around to a 180° position;

securing the side panels in the 180° position with the exterior side of the side panel adhered to an exterior side of the main panel;

removing a second protective cover from the roof adhesive on an interior surface of the side panels; and pressing the roof ventilation system between the two rafters so that the main panel extends between the rafters and the roof adhesive is secured to the underside of the roof, thereby forming the vent between the underside of the roof, the side panels, and the main panel.

8. A method of manufacturing the roof ventilation system of claim 1 comprising the steps of:

slitting an approximately 4-foot to 8-foot wide foam insulation board blank into 2 to 8 said foam insulation boards;

kerfing each of the 2 to 8 foam insulation boards into the main panel and two side panels with the breakaway section between the main panel and the side panels;

applying the fold adhesive on the exterior side of the foam insulation board, the fold adhesive located between the distal edge of the foam insulation board and the position that is twice the width of the side panel from the distal edge; and applying the roof adhesive on the interior side of the side panels.

9. The method as set forth in claim 8 wherein the insulation board is approximately 4 feet wide and the step of slitting provides 2 to 4 foam insulation boards.

10. The method as set forth in claim 8 wherein the insulation board is approximately 8 feet wide and the step of slitting provides 4 to 8 foam insulation boards.

11. The method as set forth in claim 8 wherein the step of applying the fold adhesive includes removing a backing from an adhesive tape.

12. The method as set forth in claim 8 wherein the step of applying the roof adhesive includes removing a backing from an adhesive tape.

* * * * *